United States Patent [19]

Duncan et al.

[11] Patent Number: 4,660,246

[45] Date of Patent: Apr. 28, 1987

[54] VERSATILE VACUUM CLEANING APPLIANCE

[75] Inventors: John L. Duncan; John E. Jones, both of Greenville; Martin E. Harbeck, Anderson, all of S.C.; Stephen R. Burns, Norcross, Ga.

[73] Assignee: The Singer Company, Stamford, Conn.

[21] Appl. No.: 851,190

[22] Filed: Apr. 14, 1986

[51] Int. Cl.[4] ..... A47L 5/24

[52] U.S. Cl. ..... 15/329; 15/344; 15/410

[58] Field of Search ..... 15/329, 410, 344

[56] References Cited

U.S. PATENT DOCUMENTS

| | | | |
|---|---|---|---|
| 1,558,006 | 10/1925 | Fisker | 15/344 |
| 3,758,914 | 9/1973 | Nupp et al. | 15/329 |

FOREIGN PATENT DOCUMENTS

| | | | |
|---|---|---|---|
| 398849 | 7/1924 | Fed. Rep. of Germany | 15/410 |
| 3435878 | 4/1986 | Fed. Rep. of Germany | 15/410 |
| 1066808 | 1/1954 | France | 15/410 |

*Primary Examiner*—Chris K. Moore

*Attorney, Agent, or Firm*—David L. Davis

[57] ABSTRACT

A vacuum cleaner having pivotally interconnected body and nozzle head portions and a handle which is extendable for upright floor cleaning operation or retractable for hand carried or cannister type vacuuming operation, in which the handle in retracted position fixes the cleaner body and nozzle head portions against pivotal movement.

4 Claims, 6 Drawing Figures

Fig. 2.
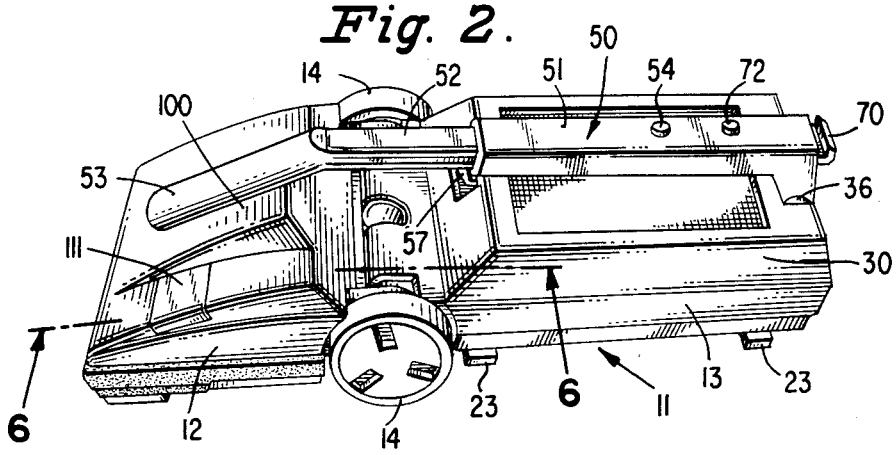
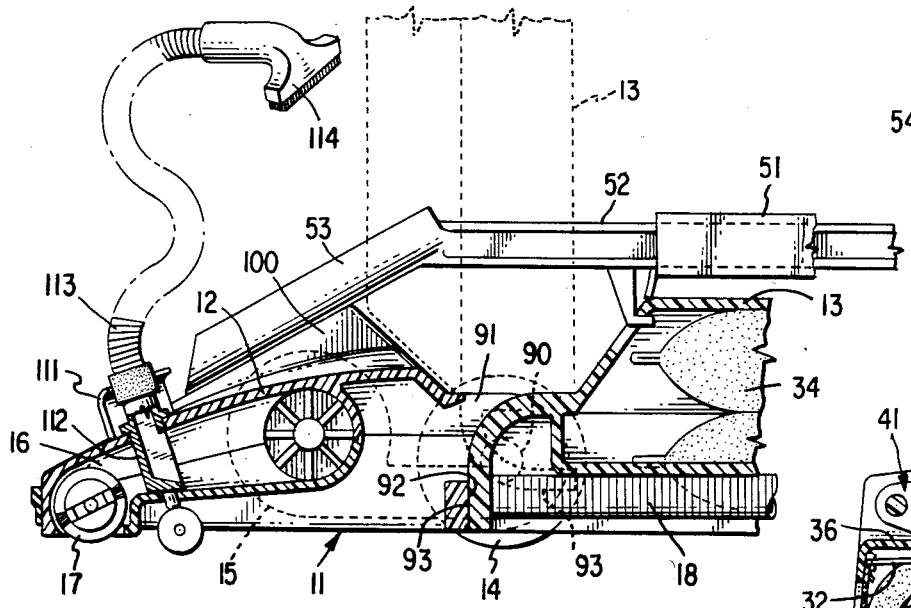
Fig. 6.
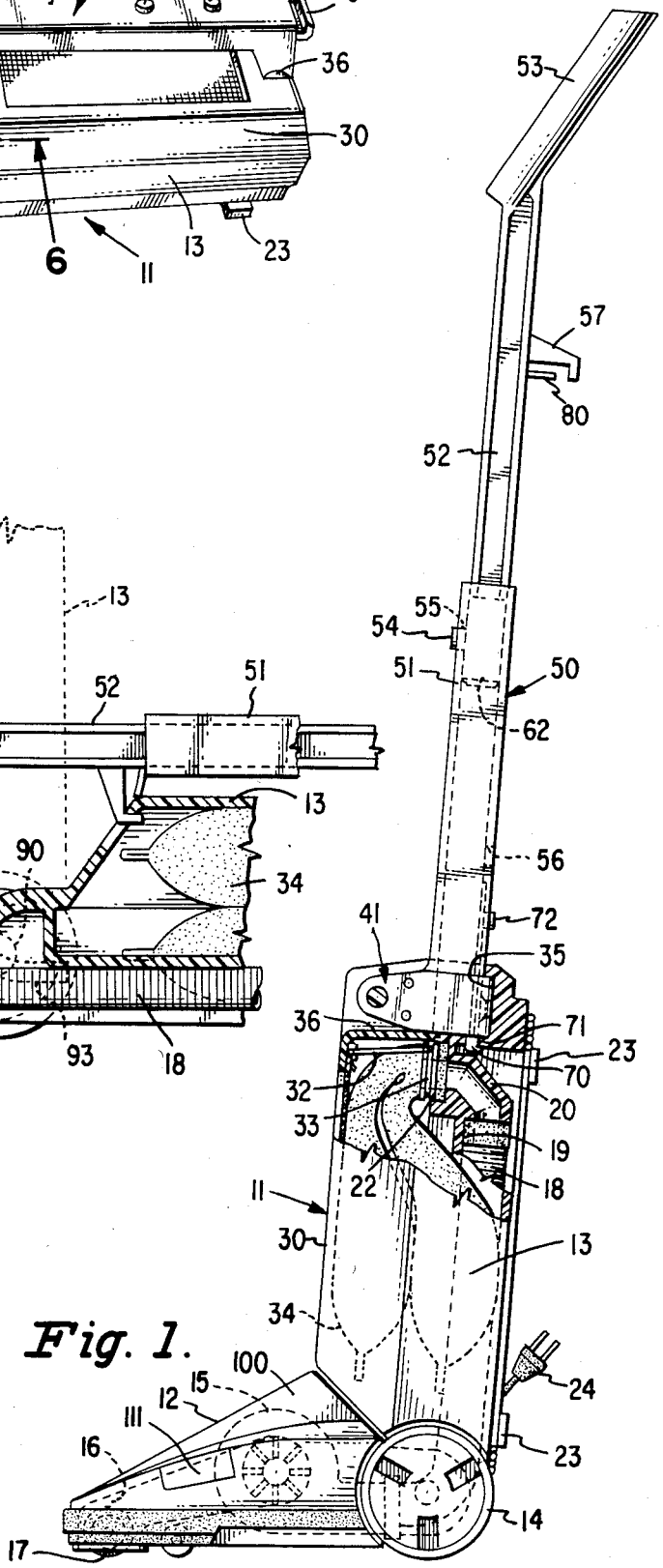
Fig. 1.

VERSATILE VACUUM CLEANING APPLIANCE

BACKGROUND OF THE INVENTION

1. Field of the Invention

This invention relates to a vacuum cleaner construction which may be converted readily into different configurations each suitable for a specifically different type of vacuum cleaning operation. More particularly, this invention provides for the conversion of vacuum cleaning apparatus selectively into an arrangement suitable for floor supported vacuuming; hand carried vacuum cleaning operation; or cannister type vacuum cleaning via a flexible hose attachment.

2. Description of the Prior Art

Known vacuum cleaners having handles selectively positionable in either an extended position for floor supported vacuum cleaning operation or retracted position for hand carried cleaning disclosed in U.S. Pat. Nos. 1,558,006 of Fisker, Oct. 20, 1925, and 3,758,914 of Nupp et al, Sept. 18, 1973, are awkward in use in both modes of operation. In floor supported mode, the handles are not pivoted to the nozzle carrying head of the cleaner so that manipulation under furniture is difficult and the cleaner does not have a stable upright position in which it can be left unattended by the operator. In the hand carried mode, these prior art devices are ungainly in length in order to accommodate the handle length necessary for floor supported use.

The U.S. Pat. No. 3,203,7087 of Anderson, Aug. 31, 1965, discloses an appliance handle which is pivoted to the appliance head during floor supported operation of the appliance; but, in the hand carried mode if applied to a vacuum cleaner, would dispose the nozzle and brush at an awkward right angle to the handle thus drastically reducing the effectiveness of hand carried vacuum cleaning operation.

SUMMARY OF THE INVENTION

It is an object of this invention to provide a vacuum cleaner construction which can be converted quickly and easily into forms suitable for floor supported vacuum cleaning operation, hand carried vacuum cleaning operation, or cannister type off-the-floor cleaning operation via a flexible hose attachment. It is a further object of this invention to provide a vacuum cleaner construction which, in each of the possible converted modes of operation, supplies features to the vacuum cleaner conducive to convenient usages of the vacuum cleaner; i.e., a handle freely pivoted with respect to the nozzle head of the cleaner in floor supported mode for access beneath furniture or the like, and stability in an upright position so that the cleaner may be parked unattended by an operator; compact rigidly interlocked arrangement of vacuum cleaner handle and nozzle head in the hand carried mode; and horizontal low-center of gravity of vacuum cleaner handle, body, and nozzle head in cannister type off-the-floor cleaning mode via a flexible hose attachment to minimize the tendency of the cleaner to overturn when drawn along by pull on the attached hose.

DESCRIPTION OF THE DRAWINGS

The above and additional objects and advantages of this invention will be apparent from the following description taken in conjunction with the accompanying drawings of a preferred embodiment in which:

FIG. 1 is a front perspective view of a vacuum cleaner having a handle in accordance with this invention applied thereto and arranged in a position suitable for floor supported operation of the vacuum cleaner;

FIG. 2 is a front perspective view of the vacuum cleaner of FIG. 1 showing the handle arranged in a position suitable for hand carried vacuum cleaner operation;

FIG. 6 is an enlarged cross sectional view taken substantially along line 6—6 of FIG. 2, and including a flexible hose fitting accommodated in the head portion of the cleaner.

DESCRIPTION OF THE PREFERRED EMBODIMENT

Figure 3:
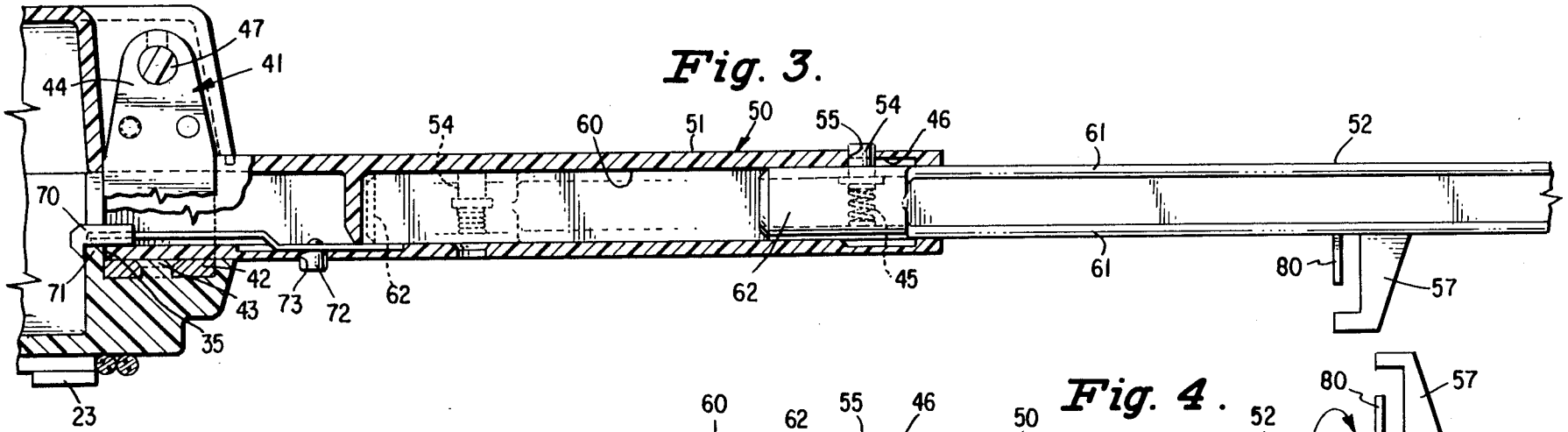
FIG. 3 is an enlarged elevational view of the handle of this invention with the parts shown interlocked in the extended position suitable for floor supported vacuum cleaner operation and with portions of the handle segments broken away and illustrated in cross section.
Figure 4:
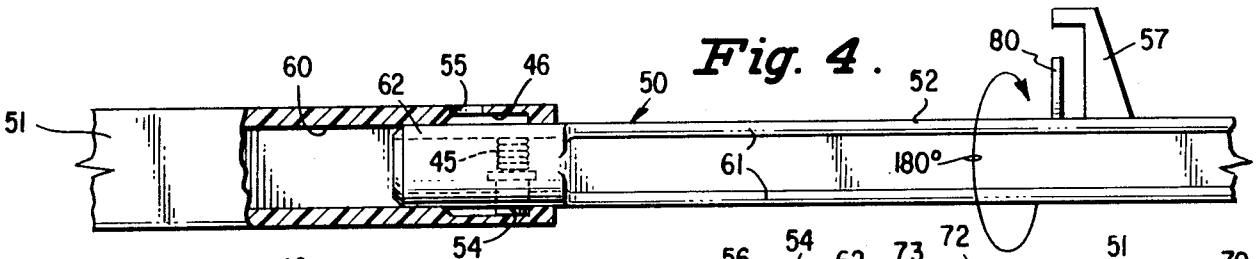
FIG. 4 is an enlarged elevational view of the handle similar to that of FIG. 3, but with the interlocks between parts released and the parts shifted to extreme extended relation suitable for accommodating relative rotation.

Referring particularly to FIG. 1 of the drawings, this invention is illustrated as applied to a vacuum cleaner indicated generally at 11 and comprising a housing including a head portion 12 pivotally connected to a body portion 13. Wheels 14 may be rotationally supported on or adjacent the pivotal connection between the head and body portions. A motor blower 15 is arranged in the head portion together with a nozzle 16 which may be fitted with a driven brush 17. A flexible tube 18 extends from the motor blower 15 in the head portion 12 along a trough 19 formed in the rear of the body portion 13 and provides a conduit to an exhaust fitting 20 providing a terminus to the air conduit from the vacuum cleaner nozzle 16. The exhaust fitting 20 is preferably fitted with a flexible gasket 22. Retaining fingers 23 extending from the rear of the vacuum cleaner body portion 13 provide storage for coils of the power cord 24 for the motor blower.

The body portion 13 of the vacuum cleaner housing is adapted to be closed by a cover 30 having the form of a shallow tray. The tray-like cover 30 is provided with a bent wire dirt bag retainer 32 shaped so as to embrace and locate a collar portion 33 of a disposable dirt collecting bag 34 in registry with the exhaust fitting 20 in effective position to separate and collect dirt from air delivered into the bag from the conduit.

Figure 5:
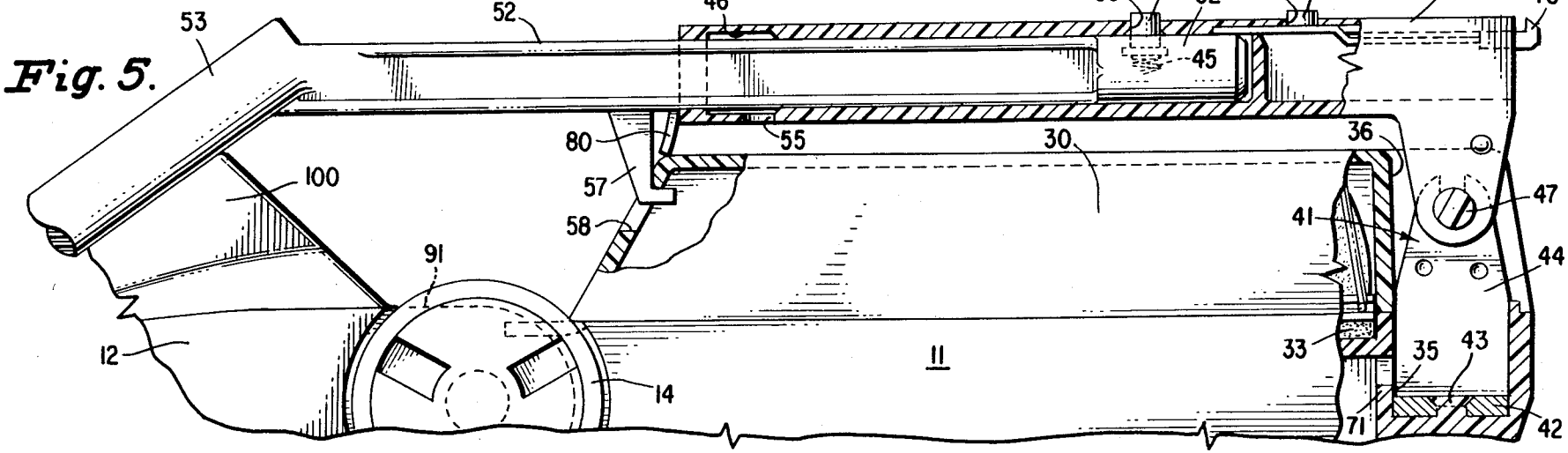
FIG. 5 is an enlarged elevational view of the handle similar to that of FIG. 3, but with the parts shown interlocked in retracted position suitable for hand carried vacuum cleaner operation.

The free extremity of the cleaner body portion 13 and the cover 30 are formed with aligned recesses 35 and 36, respectively, adapted to accommodate means for supporting a handle indicated generally at 50 on the vacuum cleaner. Preferably, the handle is supported on the cleaner body by a U-shaped bracket 41 which, as best shown in FIGS. 3 and 5, has a base 42 secured to the cleaner body by any suitable means, such as a staking 43, or use of a rivet or other fastening device. The bracket 41 is formed with a pair of bracket arms 44 in which bearing projections 47 formed on the handle 50 are journaled.

The handle 50 may be pivoted relatively to the vacuum cleaner housing selectively into either of two positions, each suitable for a different mode of vacuum cleaner operation. FIGS. 1 and 3 illustrate the extended position of the handle relatively to the cleaner housing suiting the cleaner for upright floor supported vacuum cleaning operation, while FIGS. 2, 5 and 6 illustrate the retracted position of the handle suitable for hand carried vacuum cleaning operation. The preferred construction of the handle 50 and the means for accommodating the handle in two different positions without appreciable limitation on the size and configuration of the vacuum cleaner housing will now be described.

Preferably, the handle 50 is formed with two telescopically and rotationally interrelated parts 51 and 52, part 51 being that formed with the bearing projections 47. The part 52, which is formed at one extremity with a hand grip 53, is slidable lengthwise within the handle part 51 and at the extremity opposite the hand grip carries a latch button 54 loaded by a spring 45, which latch button is engageable with a latch aperture 55 near the free extremity of the handle portion 51 to lock the handle parts in extended position, or with a latch aperture 56 near the pivoted extremity of the handle portion 51 to lock the handle parts in retracted position depending upon the relative rotational position of the handle parts. In the retracted postion of the handle parts, as shown in FIG. 5, a projection 57 on handle part 52 seats in a socket 58 in the cover 30 to constrain the handle in position for supporting the cleaner in a hand carried vacuum cleaning operation.

A major portion of both handle parts 51 and 52 are formed with rectangular configuration as shown in the perspective view of FIG. 2 and telescopically related. The extremity of the handle part 52 opposite the hand grip 53 is formed with a cylindrical cross sectional shape 62 to accommodate rotational movement of the handle parts when the latch button 54 is depressed into the aperture 55. When so depressed, the latch button 54 may be accommodated in an undercut 46 in the hollow interior 60 to prevent complete separation of the handle parts 51 and 52.

FIGS. 1 and 3 illustrate a latch device effective to constrain the handle in the extended position relatively to the cleaner housing rendering the cleaner suitable for upright floor supported vacuum cleaning operation. This latch device comprises a flexible latch element 70 secured inside the handle portion 51 and arranged protruding from the handle, as illustrated in FIGS. 1 and 3, to engage beneath a shoulder 71 on the cleaner body portion 13 to retain the handle in the postion shown in FIGS. 1 and 3. A release button 72 carried by the latch element 70 within the handle portion 51 is accessible to an operator through an aperture 73 in the handle permitting the latch element 70 to be shifted out of engagement beneath the shoulder 71 freeing the handle for pivotal movement out of the extended position.

FIG. 5 best illustrates the latch device effective to constrain the handle in the retracted position relatively to the cleaner housing rendering the cleaner suitable for hand carried vacuum cleaning operation in the form illustrated in FIG. 2.

As described above, and with particular reference to FIG. 5, when the handle part 52 is rotated 180° from the position relative to the handle part 51 shown in FIGS. 1 and 3 and the handle 50 is rotated about the bearing projections 47 into retracted position adjacent the cleaner housing, the handle part 52, upon telescopic insertion into handle part 51, shifts a projection 57 on handle part 52 into a cover socket 58 substantially simultaneously with the reception of the latch button 55 into the aperture 56 in the handle part 51. To remove any looseness in the interlocking relation between the handle and the cleaner housing, a resilient tab 80 is formed to extend from the handle part 52 adjacent to the projection 57. The tab 80 engages the cover 30 in the interlocked position of the projection within the socket 58 and, in being deflected thereby, the resilient tab 80 imposes a light force between the handle 50 and the cleaner housing to remove any slack therebetween.

With reference to FIG. 6, the pivotal connection between the cleaner head portion 12 and body portion 13 is illustrated. Indicated at 90 is an axle stud for one of the cleaner wheels 14, which axle studs are journaled in extensions 91 from the cleaner head portion 12. The studs 90 also extend laterally inward from the extensions 91 and are embraced by the body portion 13 of the cleaner to provide the pivotal connection between the cleaner housing parts 11 and 12. As shown in FIG. 6, the housing parts 11 and 12 are formed with interchanging stop surfaces 92 and 93, respectively, adjacent pivotal connections therebetween. The stop surfaces are adapted to abut defining one extreme limit of the angular range of pivotal movement between the body and head portion of the cleaner housing in which, as shown in FIGS. 2 and 6, the undersides of the head and body portions 11 and 12 are substantially coplanar.

As shown in FIGS. 2, 5 and 6, the handle, when shifted into retracted position, brings the hand grip 53 into engagement with a raised abutment projection 100 formed on the upper surface of the head portion 12 of the cleaner. As the handle parts 51 and 52 are shifted telescopically into the retracted position, the hand grip 53 acts as a cam means in engaging the projection and urging the stop surfaces 92 and 93 into engagement. Engagement of the latch button 54 into the aperture 56 of handle part 51 locks the cleaner head and body portions in this extreme position of angular relation shown in FIGS. 2, 5 and 6.

As shown in FIG. 2, the head portion 12 of the cleaner housing is formed in the upper surface with an opening into the nozzle 16 which can be closed by a hinged cover plate 111. When the cover plate 111 is swung up, as shown in FIG. 6, the opening is exposed to accommodate an adapter 112 carried by one extremity of a flexible hose 113 to the opposite extremity of which various cleaning implements such as a brush 114 or the like may be carried. The adapter 112 is shaped, as shown in FIG. 6, to block off the nozzle 16 passageway to the motor blower when the adapter is fully inserted into the opening 110 so that air will be drawn by the blower instead of through the flexible hose 113.

When the flexible hose 113 is utilized, the cleaner is adapted for use in the mode of a cannister cleaner and particularly adapted for off-the-floor cleaning operations in the course of which the cleaner housing is apt to be drawn along by forces imparted thereto by the flexible hose 113. In the form of the cleaner of this invention, as shown in FIGS. 2 and 6, the compact configuration of cleaner parts and the low silouette provided by the retracted postion of the handle 50 provides a stability to the cleaner housing which resists tipping and overturning to which the cleaner would be prone in the upright mode shown in FIG. 1.

We claim:

1. A vacuum cleaner having a body portion, a head portion having a vacuum nozzle, a pivotal connection between said body portion and said cleaner head, and stop means associated with said pivotal connection limiting pivotal movement of said parts to within a predetermined angular range;

a vacuum cleaner handle shiftably supported on said body portion for movement between an extended position for operation of said cleaner in an upright floor supported mode and a retracted position for operation of said cleaner in a hand carried mode;

first interlock means between said handle and said body portion for retaining said handle in said extended position;

second interlock means betwen said handle and said body portion for retaining said handle in said retracted position; and cooperating surfaces formed on said handle and on said cleaner head, which surfaces in the retracted position of said handle are contiguous and constrain said cleaner head against pivotal movement relative to said body portion in one extreme limit of the angular range permitted by said stop means.

2. A vacuum cleaner as set forth in claim 1 in which said handle comprises at least two telescopically arranged sections including a base section pivotally secured to said cleaner body portion and another section formed with a hand grip, in which said interlock between said handle and said cleaner body portion for retaining said handle in retracted position comprises mating surfaces on said body portion and on said hand grip section of said handle which surfaces are interengageable upon telescopic movement of said handle sections, and in which said cooperating surfaces on said handle and on said cleaner head comprise a cam means formed on said hand grip section of said handle and a follower surface formed on said cleaner head, said cooperating cam and follower surfaces being effective during telescopic movement of said handle sections into interlocked relation with said cleaner body portion in said retracted position to urge said cleaner head into one extreme limit of the angular range relative to said body portion permitted by said stop means.

3. A vacuum cleaner as set forth in claim 2 in which said hand grip comprises an extremity of said another handle section formed to extend obliquely from said another handle section, and in which said obliquely extending hand grip forms the cam means constraining the cleaner head into one extreme limit of the angular range relative to said body portion permitted by said stop means.

4. A vacuum cleaner as set forth in claim 1 in which a hose accommodating socket is provided on said head portion of said cleaner including valve means effective when a hose is accommodatd in said socket for blocking the air conduit to said vacuum nozzle.

* * * * *